US006198214B1

(12) United States Patent
Anandan et al.

(10) Patent No.: US 6,198,214 B1
(45) Date of Patent: Mar. 6, 2001

(54) LARGE AREA SPACER-LESS FIELD EMISSIVE DISPLAY PACKAGE

(75) Inventors: Munisamy Anandan, Fishkill; Olivier Prache, Pleasantville, both of NY (US)

(73) Assignee: FED Corporation, Hopewell Junction, NY (US)

( * ) Notice: Subject to any disclaimer, the term of this patent is extended or adjusted under 35 U.S.C. 154(b) by 0 days.

(21) Appl. No.: 09/095,095

(22) Filed: Jun. 10, 1998

Related U.S. Application Data

(60) Provisional application No. 60/050,475, filed on Jun. 23, 1997.

(51) Int. Cl.[7] ..... H01J 1/88

(52) U.S. Cl. ..... 313/495; 313/292; 313/309; 313/252; 313/249

(58) Field of Search ..... 313/495, 553, 313/561, 563, 564, 292, 309, 336, 351, 252, 249

(56) References Cited

U.S. PATENT DOCUMENTS

| | | | | |
|---|---|---|---|---|
| 5,210,462 | | 5/1993 | Konishi . | |
| 5,385,499 | | 1/1995 | Ogawa et al. . | |
| 5,503,582 | | 4/1996 | Cathey, Jr. et al. . | |
| 5,522,751 | | 6/1996 | Taylor et al. . | |
| 5,525,861 | * | 6/1996 | Banno et al. | 313/553 X |
| 5,562,517 | | 10/1996 | Taylor et al. . | |
| 5,603,649 | | 2/1997 | Zimmerman . | |
| 5,844,360 | * | 12/1998 | Jeong et al. | 313/336 X |
| 5,910,705 | * | 6/1999 | Banno et al. | 313/553 X |

* cited by examiner

*Primary Examiner*—Ashok Patel

(57) ABSTRACT

In order to operate Field Emission Displays ("FEDs") contain an evacuated space. Generally, two soda-lime glass substrates, separated by a vacuum gap, act as cathode and anode. The vacuum gap is essential for the electrons to be emitted from the sharp cathode tips and travel towards the anode to give up their energy to the phosphor anode plate to emit light. The two plates and the frit seal holding the vacuum gap are under strain due to the atmospheric pressure acting on them. For small size FEDs , this strain is not a problem. However, for large area FEDs, the strain is detrimental both to the glass plates (2 mm thick) and frit seal. Under the strain, both the cathode and anode plates will buckle-in towards vacuum and, in turn, stress the frit seal, causing cracks and vacuum failure. To minimize this effect and enable the FED to operate normally, a field emissive display with a support plate for the cathode plate is disclosed. The support plate may reduce deflection of the cathode plate and decrease stress on the means for sealing the cathode plate to the anode plate. The support plate may be connected to the one side of the cathode plate at multiple points along the cathode plate. The support plate may also include plural channels with rounded inner walls defining spaces between the cathode plate and the support plate. Getter material may be provided in these spaces. To facilitate communication between the getter material in each channel, passages may be provided between the channels in the support plate.

15 Claims, 3 Drawing Sheets

LARGE AREA SPACER-LESS FIELD EMISSIVE DISPLAY PACKAGE

RELATED APPLICATIONS

This application is a continuation of U.S. Provisional Patent Application Ser. No. 60/050,475 filed Jun. 23, 1997.

FIELD OF THE INVENTION

The present invention relates to packaging and design of anode, cathode and support plates in a field emissive display.

BACKGROUND OF THE INVENTION

FIG. 1 shows the cross-section of a typical FED 10 assembly; Plates 12 and 15 represent the cathode and anode plates, respectively. A glass spacer frame 13 is bonded to the anode and cathode plates via a frit seal 14. A hole in the cathode provides pump down, which is achieved through the exhaust tube 11. This tube 11 also serves as a cavity for an evaporable getter (not shown).

The interior space 16 within the FED should be evacuated of gas through the exhaust tube 11 in order for the FED to work properly. As the interior space 16 is evacuated, the pressure on the interior walls of plates 12 and 15 is vastly reduced in comparison to the pressure on the exterior walls of these plates. FIG. 2 shows what may happen when the pressure in the interior space 16 decreases to the levels required for proper operation of the FED. Under the atmospheric pressure, both the anode and the cathode plates, 15 and 12, tend to bend inward because there is no pressure within the FED to oppose the pressure being applied from outside the FED. This results in destructive compression and tension forces being applied to the frit seal 14. The inner portions of the frit seal 14 are compressed, and the outer portions of the frit seal are placed in tension. It is easy to understand that the larger the glass span of plates 12 and 15, the greater the compressive and tension forces that may be applied to the frit 14. For a given glass thickness n and seal width w, there is a maximum force which can be applied without tearing the seal 14 and cracking the plates 12 and 15. As the pixel pitch decreases (higher resolution) and the viewing area gets larger (higher information content), the pressure exerted on the anode and cathode plates, due to atmospheric pressure, becomes very high and presents a challenge to the manufacture of large area FEDs with a gap between the plates 12 and 15.

Thicker glass or stronger materials can be used for plates 12 and 15, but they do not really provide a scalable solution. While the seal width w can also be increased to spread the load and improve shear resistance, the required width often is in conflict with FED applications that require small peripheral widths of the frit seal 14. In addition, the increase in frit seal width requires larger glass plates 12 and 15, but does not increase the actual viewing area of the FED. Other display technologies, such as liquid crystal displays, do not suffer from this drawback of increased seal width.

One method of reducing the stress on the frit seals 14 is to use internal spacers within the interior space 16. Spacers are essentially insulative structures that form a bridge between the cathode plate 12 and the anode plate 15 within the interior space 16. The spacers can be used to keep a constant separation between the cathode and anode plates across the dimensions of these plates. This approach allows for the use of thin glass plates, similar to those used in the LCD technology, for the cathode 12 and anode 15 plates.

The presence of these spacers within the interior space 16 means that there can be no pixels where there are spacers.

Thus, the inclusion of internal spacers may affect display resolution. In addition, this approach may preclude the use of high voltage phosphors, considered to be the best fit for the FED technology, because of the chance that the spacers will provide a path for flashovers between the cathode and anode plates 12 and 15. Further, the high voltage operation necessitates a large space between the plates 12 and 15, which means a large spacer, thus resulting in spacer-created dark regions.

Another method for reducing frit seal stress is to use thick glass plates for the cathode and anode plates, 12 and 15, to compensate for the unbalanced pressure forces on the plates. This approach is presently being used for displays smaller than 3" in diagonal. Larger displays require a thicker glass but also an increase in the width w of the perimeter seal. This increase places limitations on the display's ability to be used in applications where border area is at a premium (for example, in avionics displays). In addition, the weight increase is likely to result in a non-competitive package, even when compared to conventional CRTs. Even the use of stronger materials, such as glass ceramics, may not remove the need for a wider frit seal in order to reduce the point shear force.

With reference to FIG. 3, a third method of reducing frit seal stress has been to use a 3-piece FED 10 assembly including a rear piece 17 in the shape of a shrunken funnel to reduce the stress on the seal 14 between the spacer frame 13 and the cathode plate 12. This approach may strengthen the assembly by providing a rear piece 17 that does not deflect under pressure as much as a flat plate. The addition of the rear piece 17, however, results in a non-flat panel, making the display more bulky.

The rear piece 17 may provide another benefit by providing a location for getter material in the FED. The operation of an FED may be highly dependent on the maintenance of a gas free vacuum between cathode and anode plates, 12 and 15. Getter material within the FED is useful in capturing gas that is inside the FED. The inclusion of a rear piece 17 results in the formation of an additional wall within the FED on which getter material may be located. The advantage of using a rear piece to house getter material, however, is counter balanced by the bulkiness of the overall FED with a shrunken funnel shaped rear piece.

OBJECTS OF THE INVENTION

It is therefore an object of the present invention to provide a means for reducing the deflection of an FED cathode plate as a result of the FED being evacuated.

It is another object of the present invention to provide a means for reducing the stress on the seal between an FED cathode plate and other elements of the FED.

It is a further object of the present invention to provide a means for stiffening an FED cathode plate.

It is still another object of the present invention to provide an FED with a space behind the cathode plate for containing getter material.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicants have developed an innovative, economical field emissive display having a cathode plate sealed to an anode plate along a periphery of the cathode plate; at least one field emissive device provided on an upper side of the cathode plate inside of the periphery; and comprising a support plate in contact with a lower side of the cathode plate at at least one point inside the cathode plate periphery.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention, and together with the detailed description serve to explain the principles of the present invention.

DETAILED DESCRIPTION OF THE PREFERRED EMBODIMENTS

Figure 4:
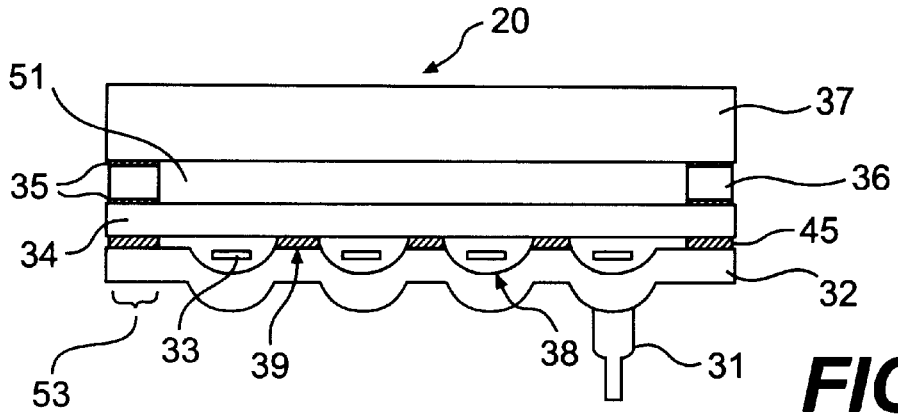
FIG. 4 is a cross-section in elevation of an FED embodiment of the invention.

The invention disclosed herein and shown in FIG. 4 provides a scalable path to manufacturing large area, spacerless field emissive displays while keeping the peripheral area of the display under control and limiting both weight and system costs. Reference will now be made in detail to a preferred embodiment of the FED of the present invention, an example of which is illustrated in the accompanying drawings. A preferred embodiment of the present invention is shown in FIG. 4 as FED 20.

In a preferred embodiment, the FED 20 may include a cathode plate 34 and an anode plate 37 spaced from one another with a spacer frame 36. The molded piece 32 may provide a stiff rear support for the cathode plate 34 as well as spaces for getter material 33. The cathode and anode plates may be sealed to the spacer frame 36 with frit seals 35 along a periphery of the plates. The anode plate 37 may be made of a conventional thick glass plate and bonded to upper side of the cathode plate 34 via a spacer frame 36 and a conventional frit seal 35. A molded glass piece (also referred to as a support plate) 32 may be sealed to the lower side of the cathode plate 34 with frit seals 45. The frit seals 45 may extend across a portion of ledges 39 and outer edges 53 without extending over all of them. E.g., the frit seals may extend substantially along points of contact between the cathode plate 34 and molded piece 32.

The molded piece 32 may consist of molded channels 38 spanning its length. The molded channels 38 may have rounded inner and/or outer walls which lend strength to the molded piece 32. Between each of the channels 38 may be a ledge 39, which is in the same level and plane as the outer edges (periphery) 53 of the molded piece 32. The ledges 39 may support the cathode plate 34 inside the periphery of the cathode plate. Each channel 38 may house getter material 33. The getter material 33 may absorb residual gas that remains in the display after a vacuum is drawn through port 31.

Figure 5:
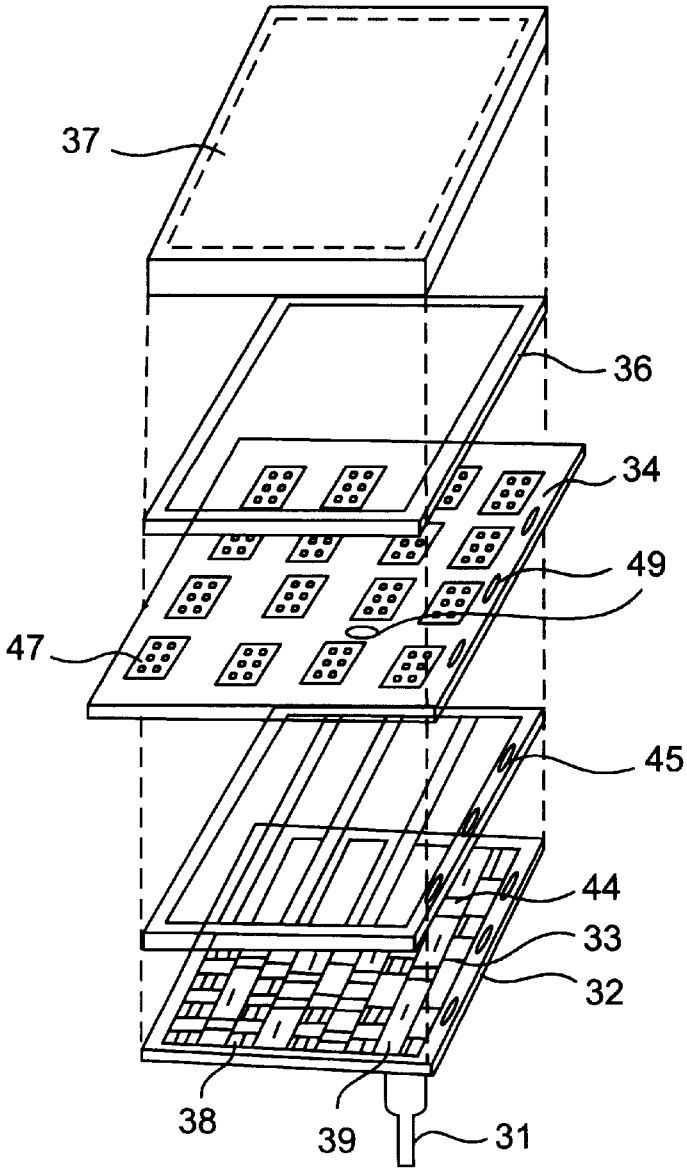
FIG. 5 is a 3-D exploded view of an FED embodiment of the invention.

With reference to FIGS. 4 and 5, each channel 38 may be connected to the other by perpendicular sub-channels 44 located at various regions along the length of the ledges 39 separating the channels 38, such that pump down may occur through a single port 31.

The cathode plate 34 may be made of thin glass (1 mm or less) and, in addition to containing the emissive matrix 47, may also include several holes 49 extending through the cathode plate 34 and providing communication between the interior FED space 51 and the channels 38. The cathode plate 34 may be bonded to the molded piece 32 using a conventional frit seal process. Note, however, that the cathode plate 34 may be bonded to the molded piece 32 not only along the periphery 53, but also along the surface of the lower side of the cathode plate inside of the periphery, such as along planar ledges 39.

Figure 6:
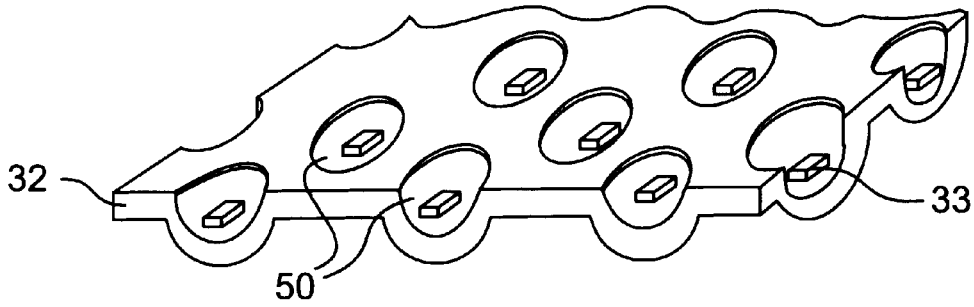
FIG. 6 is a pictorial view of a support plate cross-section used in an alternative embodiment of the invention.
Figure 7:
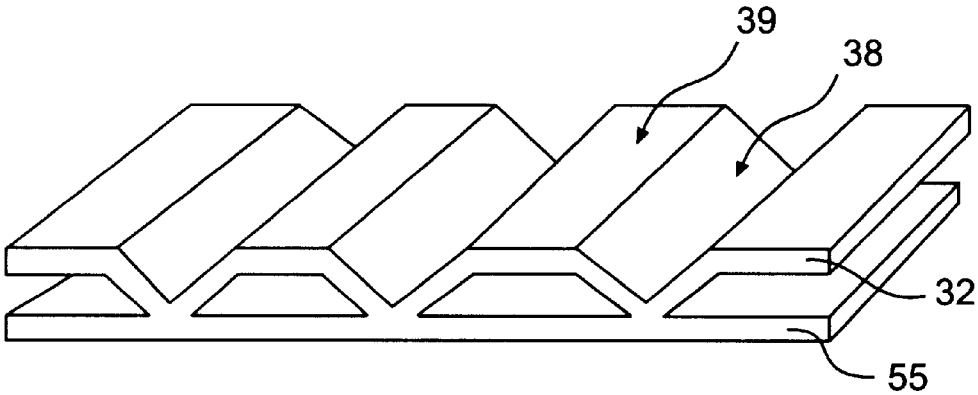
FIG. 7 is a pictorial view of a support plate cross-section used in another alternative embodiment of the invention.

With reference to FIGS. 4 and 5, variations of the FED within the scope of the invention may include a molded piece 32, an anode plate 37, and a cathode plate 34 made of glass, ceramic, glass-ceramic, or other suitable insulative material. The molded piece may have any shape or size which lends strength to the overall FED structure. More particularly, the molded piece 32 may be provided with one or more channels 38 and one or more ledges 39. The channels 38 need not necessarily be rounded or columnar, however. With reference to FIG. 6, in one variation the channels may take the form of indentations 50 in the mold piece 32. Alternatively, the channels 38 may take the form of V-shaped indentations, as shown in FIG. 7. The molded piece 32 may also include additional support features 55 as shown in FIG. 7.

Variations of the invention contemplate subchannels 44 and ledges 39 of various sizes and shapes. For example, ledges 39 may be reduced in size such that the ledges and subchannels 44 take on a checkered pattern of open and closed spaces of near equal dimension. The invention contemplates the inclusion of ledges 39 of any design, so long as it lends strength to the overall FED structure.

BENEFITS OF THE INVENTION

Figure 3:
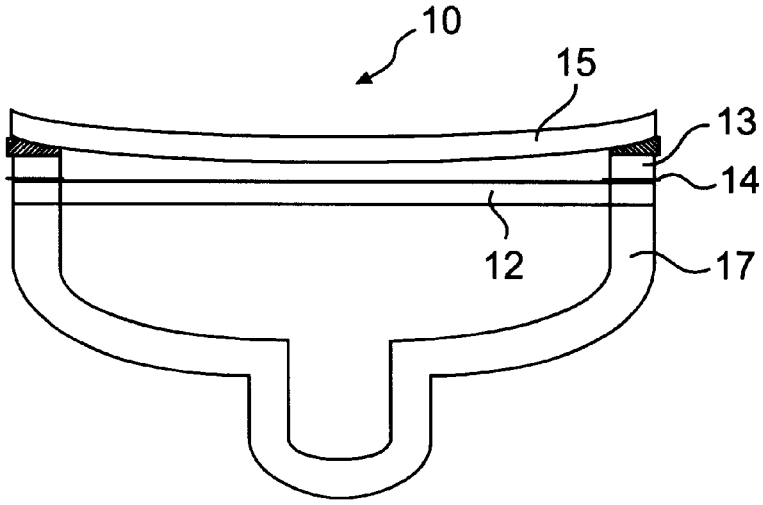

A benefit of this invention may be realized by the added strength provided by the molded piece 32. The form of the molded piece 32, with the channels 38, may provide substantial strength to the cathode plate 34 without adding substantial weight or bulkiness to the overall FED 20. Unlike the other three-piece assembly shown in FIG. 3, the resulting FED has a relatively flat bottom that facilitates integration of the FED into a space conscious system (such as an avionics display system).

The ledges 39 of the molded piece 32 also add strength because they provide additional bonding surface to seal the cathode plate 34 to the molded piece 32. The bonds to the molded piece 32 along the width of the cathode plate 34 thus may aid in reducing the deflection of the cathode plate.

The use of the molded piece 32 for support may also provide a cost benefit. For example, it allows for the use of ordinary soda lime glass to construct the cathode plate 34, thereby reducing any cost increase that may be attributable to the addition of the molded piece. Instead of strengthening the cathode plate by constructing it of expensive glass ceramics, a molded piece may be used to provide additional strength to an ordinary soda lime glass cathode plate 34, while keeping the thickness down.

The use of soda lime glass for the cathode plate 34 and/or other assembly components may lend another benefit to the FED of the invention. While a glass ceramic cathode plate 34 could result in a thinner FED 20, it would require higher sealing temperatures for the frit seals between the anode plate 37 and the cathode plate 34. This temperature (approx. 525° C.) is currently beyond the recommended limits for the phosphors that may be used on the anode plate 37. A soda lime glass anode plate 37 and cathode plate 34 can be sealed together using frit seals that melt at lower temperatures (450° C.) than other candidate materials, such as glass ceramics. The use of the lower temperature frit seals may thereby reduce the risk of phosphor degradation. While the soda lime glass anode and cathode plates are not as strong as glass ceramic alternatives for a given thickness, the strength problem can be solved by using a strengthening molded piece 32.

Figure 1:
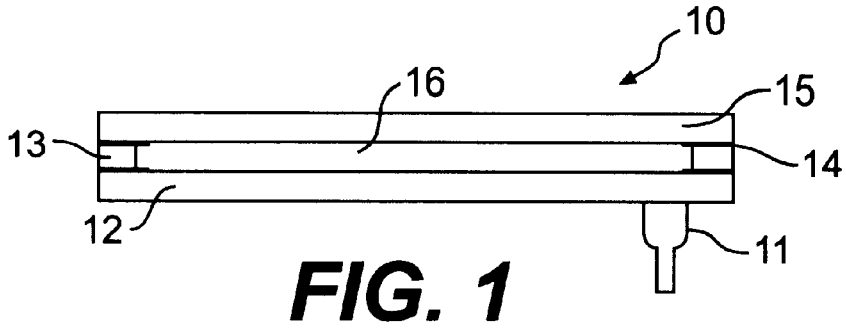
FIG. 1 is a cross-section in elevation of an FED.
Figure 2:
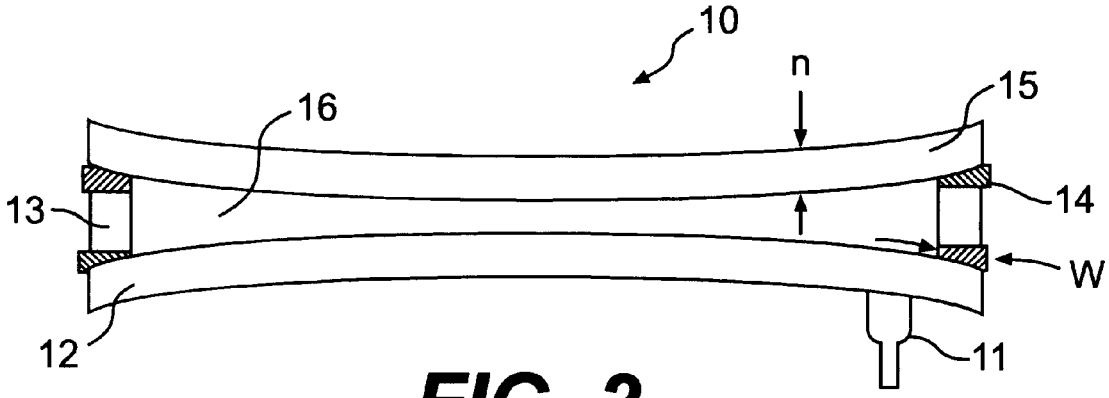
FIGS. 2 and 3 are cross-sections in elevation of FED's illustrating the deformation that occurs after a vacuum is drawn in the FED.

Another benefit of the invention may be realized by the addition of space to provide getter material in the FED. The operation of an FED depends in part on the removal of gas from the space between the cathode plate 34 and the anode plate 37. Even if an almost perfect vacuum can be attained before the exhaust tube 31 is sealed off, gas may later build up in the device as a result of outgassing over time from materials in the FED 20. Therefore, to maintain vacuum conditions in the FED, it is desirable to provide material in the FED that can absorb gas as it builds up in the FED. Getter materials have been used to fulfill this need, however, the inclusion of getters necessitates a place to hold the getters. Unlike the design shown in FIG. 1, which accurately describes existing implementations, the invention provides increased space to accommodate large amounts of getter material without greatly increasing the bulkiness of the overall FED. The primary impact of this benefit is extended operational life, and to some extent more tolerance in the manufacturing process of the FED.

We claim:

1. In a field emissive display having a cathode plate sealed to an anode plate along a periphery of the cathode plate and wherein the cathode plate has at least one field emissive device provided on an upper side of the cathode plate inside of the cathode plate periphery, the improvement comprising a support plate in contact with a lower side of the cathode plate at at least one point inside the cathode plate periphery.

2. The display of claim 1 wherein said support plate contacts the cathode plate lower side at plural points inside the cathode plate periphery and said support plate includes a channel between two points of contact between the support plate and the cathode plate.

3. The display of claim 2 wherein getter material is provided in said channel.

4. The display of claim 2 wherein said support plate includes plural channels and at least one communication passage between two of said channels.

5. The display of claim 1 wherein said support plate is connected to the lower side of the cathode plate at a point of contact between the support plate and the cathode plate.

6. The display of claim 2 wherein said cathode plate includes at least one hole therein extending from the cathode plate upper side to the cathode plate lower side above said channel.

7. The display of claim 1 wherein said support plate comprises a multi-channelled member sealed to said cathode plate lower side along the periphery of the cathode plate.

8. A field emissive display comprising:

a cathode plate having an upper side, a lower side, and a periphery;

a transparent anode plate spaced from the cathode plate upper side with a spacer frame;

means for sealing said spacer frame to said cathode plate along the periphery thereof; and means for stiffening said cathode plate, said means for stiffening connected to said cathode plate lower side at a point inside the periphery of the cathode plate.

9. The display of claim 8 wherein said means for stiffening comprises plural channels formed therein, said channels defining spaces between the cathode plate lower side and the means for stiffening.

10. The display of claim 9 further comprising getter material in at least one of said spaces.

11. The display of claim 10 further comprising at least one communication passage between two of the plural channels.

12. The display of claim 11 further comprising at least one hole in the cathode plate extending from the cathode plate upper side to the cathode plate lower side above at least one of the plural channels.

13. The display of claim 12 wherein said plural channels comprise rounded inner walls.

14. The display of claim 13 wherein said means for stiffening is sealed to said cathode plate lower side along all points of contact between the cathode plate and the stiffening means.

15. A field emissive display comprising:

a cathode plate having an upper side, a lower side, and a periphery;

a transparent anode plate spaced from the cathode plate upper side with a spacer frame;

means for sealing said spacer frame to said cathode plate along the periphery thereof;

means for stiffening said cathode plate, said means for stiffening contacting said cathode plate lower side at one or more points inside the periphery of the cathode plate;

plural channels with rounded inner walls formed in the means for stiffening, said channels defining spaces between the cathode plate lower side and the means for stiffening;

getter material in at least one of said spaces;

a communication passage between two of the plural channels; and a hole in the cathode plate extending from the cathode plate upper side to the cathode plate lower side above at least one of the plural channels, wherein said means for stiffening is sealed to said cathode plate lower side along substantially all points of contact between the cathode plate and the stiffening means.

* * * * *